United States Patent [19]

Moisan et al.

[11] Patent Number: 4,810,933

[45] Date of Patent: Mar. 7, 1989

[54] SURFACE WAVE LAUNCHERS TO PRODUCE PLASMA COLUMNS AND MEANS FOR PRODUCING PLASMA OF DIFFERENT SHAPES

[75] Inventors: Michel Moisan; Zenon Zakrzewski, both of Montreal, Canada

[73] Assignee: Universite de Montreal, Montreal, Canada

[21] Appl. No.: 903,519

[22] Filed: Jul. 2, 1986

[30] Foreign Application Priority Data

Jul. 5, 1985 [CA] Canada ..... 486389

[51] Int. Cl.[4] ..... H01J 11/04; H01J 65/04; H01P 1/20

[52] U.S. Cl. ..... 315/39; 313/231.31; 313/485; 313/493; 315/111.21; 315/248; 333/24 C; 333/99 PL; 333/32; 333/232; 219/10.55 R

[58] Field of Search ..... 315/39, 111.21, 111.41, 315/248; 219/121 P, 10.55 A; 313/231.31, 485, 493; 333/24 C, 32, 99 PL, 99 R, 35, 232; 330/56

[56] References Cited

U.S. PATENT DOCUMENTS

| | | | |
|---|---|---|---|
| 3,466,497 | 9/1969 | Clark et al. | 315/39 |
| 3,600,712 | 8/1971 | Williamson | 315/39 X |
| 3,641,389 | 2/1972 | Leidigh | 315/39 |
| 3,891,948 | 6/1975 | Destrade et al. | 333/233 X |
| 3,904,995 | 9/1975 | Phillips | 330/56 X |
| 4,018,642 | 4/1977 | Pike et al. | 219/10.55 A |
| 4,049,940 | 9/1977 | Moisan et al. | 315/39 X |
| 4,054,850 | 10/1977 | Gerrish | 333/99 R |
| 4,144,434 | 3/1979 | Chiron et al. | 333/248 |
| 4,334,203 | 6/1982 | Aurand | 330/56 X |
| 4,399,341 | 8/1983 | Yasuoka | 333/246 |
| 4,401,873 | 8/1983 | Berggren | 219/10.55 A |
| 4,527,091 | 7/1985 | Preist | 315/39 X |
| 4,551,694 | 11/1985 | Biehl et al. | 333/24 C |

OTHER PUBLICATIONS

IEEE Transactions on Plasma Science, vol. PS-3, No. 2, Jun. 1975, "A Small Microwave Plasma Source for Long Column Production Without Magnetic Field", Michael Moisan, Claude Beaudry and Philippe Leprince.

*Primary Examiner*—Leo H. Boudreau
*Assistant Examiner*—Mark R. Powell
*Attorney, Agent, or Firm*—Cushman, Darby & Cushman

[57] ABSTRACT

The present invention relates to a device for generating plasma (ionizing gas) by a propagating surface wave. The device comprises a wave launching structure mounted on a plasma vessel and connected to an impedance matching network. The latter comprises a coupler and a tuner which is either formed by a section of a transmission line or is of the lumped circuitry type. The launching structure may either generate an azimuthally symmetric or a non symmetric propagating wave. This invention also relates to a method and a device for shaping plasma which comprises a plasma vessel receiving a surface wave generator and having a serviceable portion of a size and/or shape substantially different from the shape and/or size of the portion of the plasma vessel receiving the wave generator.

24 Claims, 5 Drawing Sheets

SURFACE WAVE LAUNCHERS TO PRODUCE PLASMA COLUMNS AND MEANS FOR PRODUCING PLASMA OF DIFFERENT SHAPES

The present invention relates to a device for producing a plasma by the electric field of a propagating electromagnetic surface wave. The invention also comprehends an apparatus and a method for shaping the plasma generated by a propagating surface wave.

Devices for generating plasma have been known for many years. An example of a conventional plasma generator, of the so called DC discharge type, comprises an elongated tube containing a gas to be energized. Two electrodes protrude into the tube and discharge is created in response to a DC voltage applied to the electrodes. The gas in the tube is ionized and creates the plasma.

However, the DC plasma generators present numerous drawbacks. For example, it has been observed that the electrodes wear out and must be replaced after a certain period of time. Also, the electrode's erosion contaminates the plasma gas rendering the apparatus unsuitable for applications where gas purity is required.

In order to obviate these disadvantages, a new method for generating plasma has been created in the recent years. According to this method, the electric field of a surface wave propagating along the plasma vessel is employed to energize the gas and sustain the discharge. A distinctive property of surface waves (SW) is that, when excited at the interface between the plasma and the surrounding dielectric media, they propagate along this interface without need for any additional wave-guiding structure. In such a SW plasma generator the gas is contained in a discharge vessael, the walls of which are made of a low loss dielectric material, allowing the EM field to penetrate throughout. The electric component of the EM field applied to the gas accelerates the electrons within it and these, in turn, through collisions, ionize some of the gas particles, thus forming the plasma. Once the gas in the plasma vessel has been ionized, surface waves can propagate using the interface between the tube and the plasma, and will sustain the latter.

The surface waves are excited through a relatively small high-frequency launching structure that surrounds only a portion of the plasma tube. The plasma column length increases with the increase of supplied power. Therefore, plasma columns, much longer than the launching device itself can be readily obtained. As an example, a launching structure occupying a few centimeter along theplasma tube can be used to producea few meters long plasma column. In fact, the plasma columns obtainable by a surface wave plasma generator are limited only either by the length of the plasma tube itself or by the amount of power that the launcher and the discharge tube can withstand.

An example of such a device based on the above principle is the subject of U.S. Pat. No. 4,049,940 issued on Sept. 20, 1977, to ANVAR. The device described in this document comprises an integrated metallic structure coaxially mounted on the plasma vessel and performing the tasks of launching a SW and of optimizing the power transfer to the plasma. The wave launching carried out is by a gap defined between two metalic members. The device also comprises an impedance matching network integrated with the metallic members for ensuring an optimum power transfer from a power generator to the plasma.

However, that such device while being generally satisfactoy when operating with high-frequency surface wave, presents some drawbacks when an operation at low frequencies, i.e. below 100 MHz is required. In fact, the plasma generator grows so large at low frequencies that it becomes cumbersome even in a laboratory. For example, a plasma generator that can be perfectly matched at 80 MHz is about 70 cm long and it is no longer attractive for most applications.

The surface wave plasma generators exhibit many desirable properties relative to other kinds of plasma generators, especially of the DC type, as it appears from the above comments. However, in some areas the attractiveness of the surface wave plasmas has been imparted by their limited volume. Plasmas of large volume are required for example in plasma chemistry, in surface processing over large areas and, as an active medium for large diameter lasers. However, the diameter of the plasma vessel, over which the wave can be launched, cannot exceed approximately $\lambda/4$, or preferably should be less than $\lambda/8$ where $\lambda$ is the free space wavelength of the propagating wave. Therefore, increasing the plasma volume can be achieved only by lowering the wave frequency. This, however, leads to increased dimensions of the wave launcher and drastically reduces the available electron density (the density is approximately proportional to the frequency squared). Further, for some applications, the required shape of the usable portion of the plasma tube does not correspond to the shape of the plasma vessel section on which the wave launcher is mounted. Therefore, the need for a plasma shaping device allowing to provide plasmas of various shapes and sizes has been felt for some time.

Accordingly, it is an object of this invention to provide a surfacewave plasma generator capable of operating at relatively low frequencies and at the same time being of a relatively small size.

Another object of this invention is to provide a surface wave plasma generator capable of exciting an azimuthally non symmetric surface wave.

A further object of this invention is to provide a methodand a device for shaping plasma generated by a propagating surface wave.

In a first embodiment, the device for generating plasma, according to this invention, comprises a wave launching structure mounted on the plasma vessel and to which is attached an impedance matching network constituted by a lumped circuitry, i.e. comprising discrete inductive and/or capacitive components. The impedance matching network is connected between the launcher and a power generator supplying energy to the plasma.

The impedance matching network is preferably adjustable for achieving an optimum energy transfer from the generator to the launching structure and also for achieving a satisfactory operation at different frequencies.

Another embodiment of a surface wave plasma generator according to this invention, comprises a wave launching structure mounted to the plasma vessel and to which is attached a tuner, preferably adjustable. The tuner may be constituted by a standard coaxial transmission line with a movable short circuit at one end and connected to the launching structure through a connector. The tuner may also be constituted by a balanced line. Also, mounted on the launching module is a movable capacitive coupler through which power from the feeding line is coupled to the launcher.

For exciting an azimuthally non symmetric surface wave, according to this invention, the surface wave plasma generator comprises a launching structure constituted by two metallic members mounted on the circumference of the plasma vessel and facing each other. To the lauching structure is connected on impedance matching network through which a power generator supplies energy to the plasma. It is important that the electric waves reaching the metallic members are in a proper phase relatively to each other, the required phase relations depending on the wave mode to be excited. A phase difference of 180° corresponds to the so called dipolar mode but the operation is not limited to such a case.

The surface wave plasma generators according to this invention, whose structure has been outlined above, may be of a modular construction for facilitating the interchangeability of the launching structures (e.g. to accommodate tubes of various diameters) and the impedance matching networks to operate in various frequency domains. Such modular construction also facilitates the installation of the plasma generator over the plasma vessel.

The method and the device for shaping plasma according to this invention, exploit a fundamental property of the surface waves which is that they propagate along the interface between media of different electromagnetic parameters. Since, as stated earlier, the diameter of the tube which receives the launching structure, cannot substantially exceed $\lambda/4$ and in most of the cases should preferably be less than $\lambda/8$, a way of obtaining, for example, a discharge cross-section having a much larger diameter than the diameter of the plasma vessel section receiving the launching structure, consists of enlarging, as required, the usable portion of the plasma vessel. It has been found that the surface wave will propagate and will follow the enlarged if not too abrupt and create therein a much larger diameter plasma than in the launching region.

In fact, various shapes and sizes of plasma may be produced by forming the usable portion of the plasma vessel according to the desired plasma shape. Further, closed usable portions may be utilized such as spherical or pear shaped bulbs.

A plasma generated in closed bulb shaped vessel may advantageously be used as a lamp.

Further, the axial distribution of the electron density in the plasma may be shaped by utilizing an axially non uniform plasma vessel. For example, it has been shown that the axial density profile of the plasma depends upon the shape and/or size of the vessel and using conical plasma vessels having different characteristics, the axial density profile may be varied.

Accordingly, the present invention comprises a device for generating a plasma in a dielectric vessel containing a gas to be energized said device comprising:

an electromagnetic propagating surface wave launching structure having an opening adapted to receive therein said vessel of dielectric material, said wave launching structure including first and second metallic members slightly spaced apart from each other in order to define a launching gap therebetween for reproducing an electromagnetic field configuration for said surface wave to be excited;

a coupler mounted to said wave launching structure, said coupler defining a capacitance with said launching structure, and being adapted to be connected to a power generator for coupling power therefrom to said wave launching structure through said capacitance; and a tuner constituted by a length of a short circuited coaxial transmission line connected between said first and second members for introducing an imaginary impedance therebetween.

The invention also comprises a device for generating a plasma in a dielectric vessel containing a gas to be energized, said device comprising:

an electromagnetic propagating surface wave launching structure having an opening adapted to receive therein said vessel of dielectric material, said wave launching structure including first and second metallic members slightly spaced apart from each other in order to define a launching gap therebetween for reproducing, an electromagnetic field configuration surface wave to be excited;

a coupler mounted to said wave launching structure, said coupler defining a capacitance with said launching structure, and being connected to a power generator for coupling power therefrom to said wave launching structure through said capacitance; and tuning means of a balanced line type attached to said wave launchingstructure and being electrically connected to said first and second members for establishing an imaginary impedance therebetween.

The present invention alsocomprises a device for generating a plasma in a dielectric vessel extending along an axis and containing a gas to be energized, said device comprising:

an electromagnetic propagating surface wave launching structure having an opening which is to receive said vessel of dielectric material, said wave launching structure including first and second metallic members slightly spaced apart from each other to define a launching gap therebetween for reproducing, an electromagnetic field configuration of said surface wave to be excited;

an impedance matching network connected to said first and second members said impedance matching networks being formed of lumped-parameter elements, said impedance matching network being adapted to be connected to a powergenerator, said impedance matching network establishing a power transfer from said generator to said surface wave launching structure.

This invention further comprises a device for generating a plasma in a dielectric vessel containing a gas to be energized, said device comprising:

an azimuthally non symmetric propagating surface wave launching structure having an opening adapted to receive therein said vessel, said wave launching structure including first and second metallic members mounted on either side of said vessel and facing each other, said metallic members being slightly spaced apart from each other to define a launching zone for exciting an azimuthally nonsymmetric surface wave adapted to propagate in said vessel; and an impedance matching network connected to said launching structure and adapted to be connected to a power generator supplying energy to impedance matching network, said power generator operating at a frequency compatible with said impedance matching network and said launching structure, said impedance matching network sending an electric wave to each metallic member, the potentials at said first and second metallic members having a phase difference therebetween.

The plasma shaping device according to this invention most generally comprises a surface wave plasma generating device, comprising:

a surface wave launcher having an opening said surface wave launcher being adapted to be connected to a power supply a vessel of dielectric material containing a gas to be energized, by an electric field of a SW launched by said launcher said vessel including:

(a) a launcher receiving portion mounted in said opening;

(b) a usable portion having a shape and a size corresponding to the shape and the size of the plasma to be produced, said usable portion having a shape and/or size substantially different from the shape and/or size of ssaid launcher receiving portion.

This invention further comprises a method of producing a plasma having a given shape and size, said plasma being produced by a propagating surface wave, said method comprising the steps of:

generating a plasma in a dielectric vessel containing a gas to be energized, the plasma being generated by a surface wave excited by a launcher and propagating along said vessel, said launcher having an opening receiving a portion of said vessel, said portion closely conforming to said opening, said portion having a shape and/or size substantially different from the shape and/or size of the plasma to be produced; and conforming the surface wave emitted by said launcher to the shape and size of the plasma to inside said vessel.

The present invention also includes:

a surface wave plasma generating device comprising:

a surface wave launcher having an opening said surface wave launcher being adapted to be connected to a power supply;

a tapered vessel of dielectric material containing a gas to be energized and being inserted in said opening, the plasma is to be formed in said tapered vessel, said plasma having an axial density profile influenced by the shape and/or size of said vessel.

A detailed description of several embodiments of the present invention will now be given with reference to the annexed drawings in which.

Figure 14:
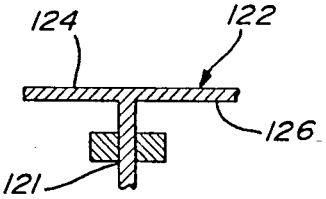
Figure 14A:
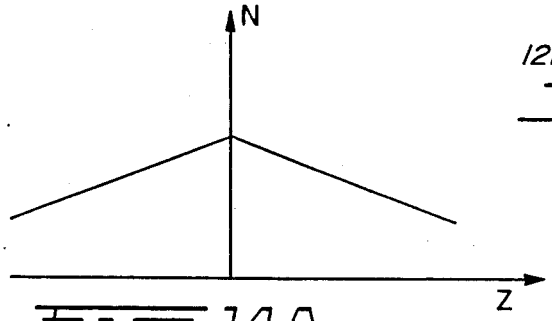
Figure 18:
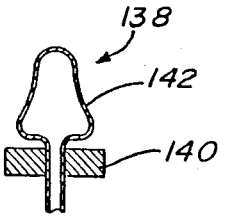
Figure 19:
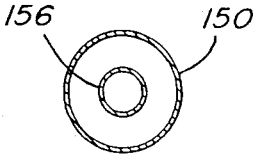
Figure 20:
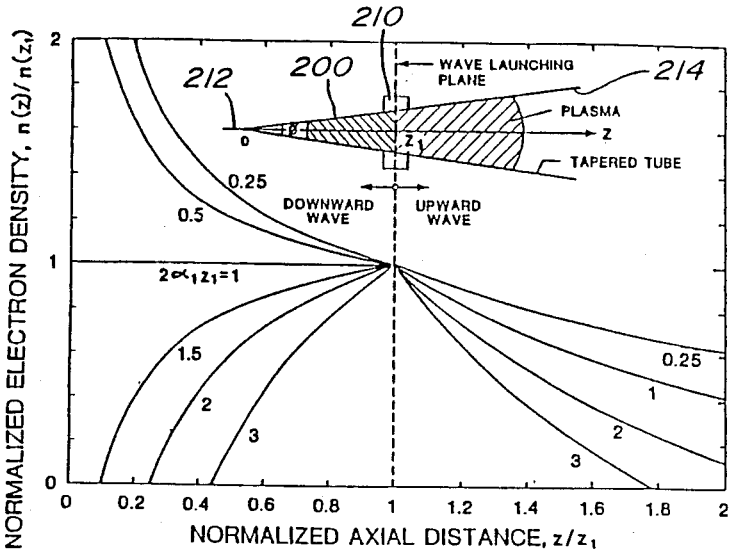

FIG. 14*a* is a graph showing the relation between the electron density and the distance from the launching region in the device of FIG. 14;

FIGS. 15 to 19 illustrate further embodiments of plasma shaping devices according to this invention; and FIG. 20 illustrates a tapered plasma vessel and a graph showing the relationship between the normalized electron density and the normalized axial distance of the vessel.

Figure 1:
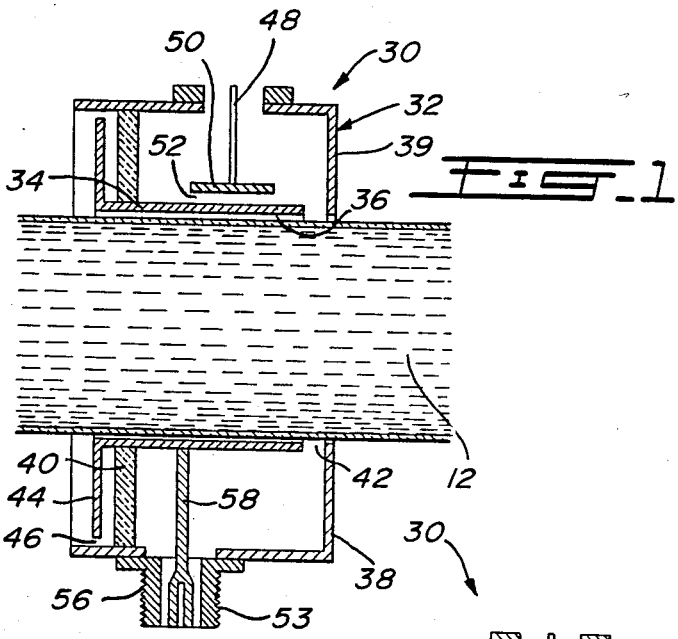
FIG. 1 is a sectional view of an embodiment of a surface wave launching structure according to this invention.
Figure 2:
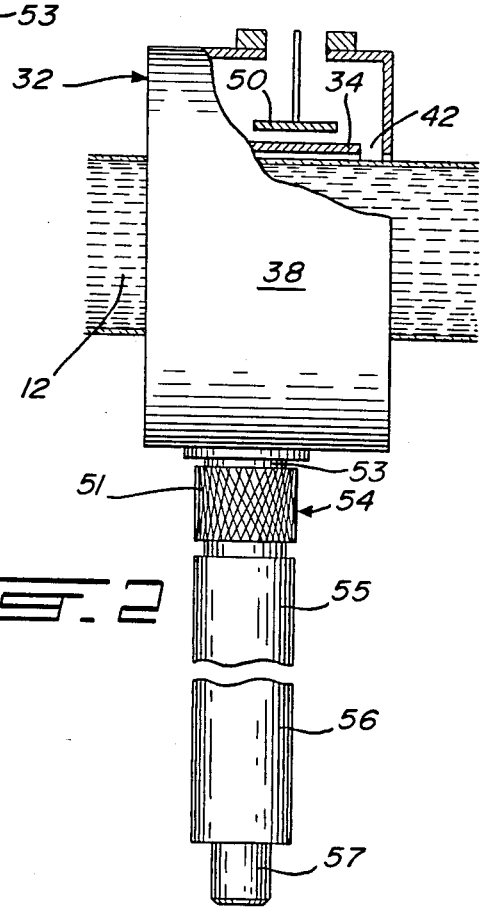
FIG. 2 is a side view, partly sectionnal, of a plasma generator whose launching structure is illustrated in FIG. 1.

With reference to FIGS. 1 and 2, a surface wave plasma generator 30 comprises a wave launching structure 32 to which is mounted an impedance matching network constituted by a coupler 48 and a tuner 55. Launcher 32 is coaxially mounted on a plasma vessel 12, made of dielectric material and containing a gas to be energized. Launcher 32 comprises metallic sleeve or member 34 defining an opening 36 through which tube 12 is to be inserted and also comprises an outer metallic member 38 coaxial to member 34 and being attached thereto by an insulating ring 40 made, for example, of Teflon (Trademark) material. Members 34 and 38 are slightly spaced apart from each other and member 38 comprises a radially inward projecting wall 39 extending toward member 34 and defining therewith a wave launching gap 42 for obtaining the desired field distribution of the surface wave to be excited. For reducing as much as possible spurious field components in the launching gap vicinity, a flange 44 is formed at one end of member 34. A small spacing 46 is left between flange 44 and outer member 38.

Coupler 48 comprises a plate 50 and is connected to the inner conductor of a semi-rigid coaxial cable (not shown) connected in turn to a suitable power generator (not shown). The shield of the coaxial cable is connected to member 38.

Plate 50 parallel with member 34 defines a capacitance through spacing 52, thrugh which the power from the generator is coupled to the launcher 32. The coupler 48 is radially moveable by any suitable means (not shown) for adjusting the capacitive spacing 52 for tuning purposes.

On the outer member 38 is mounted the male part 53 of a two terminals connector 54 having an outer metallic threaded surface56 and a central conductor or terminal 58 connected to member 34.

The threaded surface 56 constitutes the other terminal of connector 54 and is electrically connected to member 38.

With reference to FIG. 2, the part 53 threadedly receives the matching part 51 of connector 54 to which is connected a tuner 55 constituted by a length of coaxial transmission line 56 short-circuited at one end 57. Such coaxial line introduces an imaginary impedance where it is connected.

The wave launcher 32 provides an unsymmetrical plasma column with respect to the launching gap 42, since the surface wave emitted therethrough, toward flange 44, is more rapidly damped that the wave emitted in the other direction. Therefore, the plasma extending towards flange 44 will be shorter than the plasma extending in the other direction. By varying the length of members 34 and 38, the dampening effect may be adjusted.

Launching structure 32 is mainly capable of exciting an azimuthally symetric surface wave.

Figure 3:
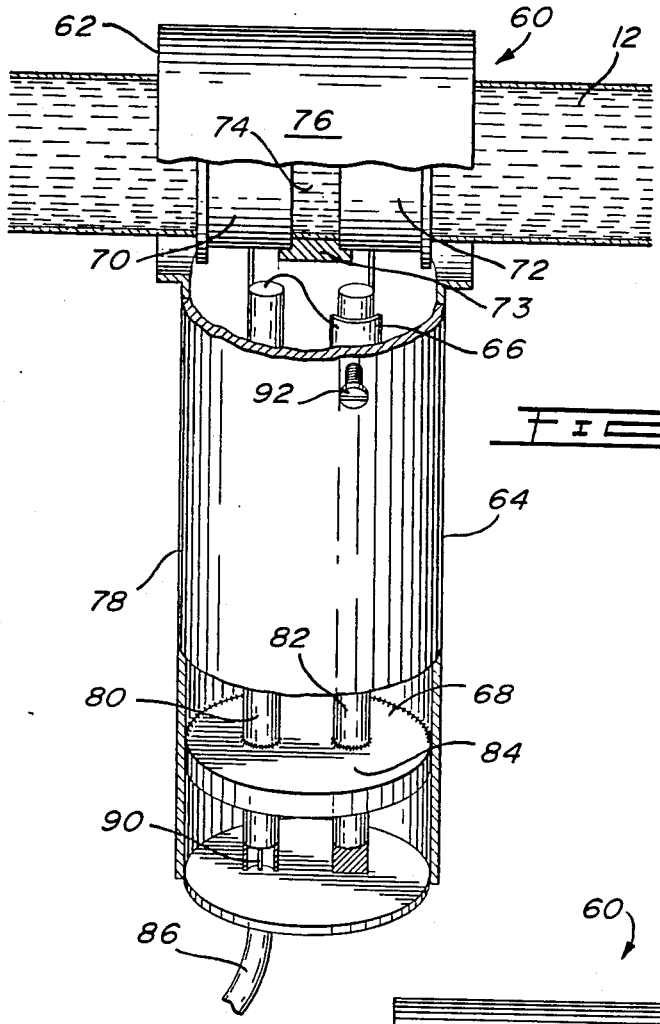
FIG. 3 is a perspective view, partly sectional of another embodiment of a plasma generator according to this invention.

FIG. 3 illustrates a surface wave plasma generator 60 designed to produce an axially symmetrical plasma with respect to the launching gap region. The generator 60 is designed to be fed with a symmetric line and comprises a wave launching structure 62 to which is connected an impedance matching network 64 comprising a coupler 66 and a tuner 68 of a balanced line type.

The launching structure 62 comprises two symmetrical metallic members or sleeves, 70 and 72 coaxially mounted on the plasma vessel 12. Members 70 and 72 are slightly spaced apart from each other for defining a launching gap region 74. Members 70 and 72 are retained to a casing 76 by a ring 73 of insulating material. Casing 76 projects laterally relative to vessel 12 and joins a sleeve 78 containing the impedance matching network 64 comprising the coupler 66 and the tuner 68.

Tuner 68 is constituted by two parallel metallic conductors 80 and 82 connected to members 70 and 72 and being short-circuited by a slidably movable plate 84. The tuner 68 introduces an imaginary impedance between members 70 and 72, which may be adjusted by moving the sliding plate 84. The latter is in electrical contact with casing 78 and it is guided by the latter.

The outer conductor of a coaxial cable 86 from a power generator (not shown) is connected to the casing 78. The central conductor 90 of cable 86 passes inside conductor 80 and forms a section of a coaxial line. Conductor 90 is connected to coupler 66 defining a capacitance with conductor 82 and with member 72 since the two are connected together. Coupler 66 is retained to casing 78 by a dielectric screw 92 threadedly engaged therein. By rotating screw 92 this capacitance may be adjusted by varying the distance between coupler 66 and conductor 82.

It should be noted that the impedance matching network 64 not only ensures the possibility of impedance matching but also performs the functions of a balun transformer from a coaxial feeder to a symmetrical line.

Figure 4:
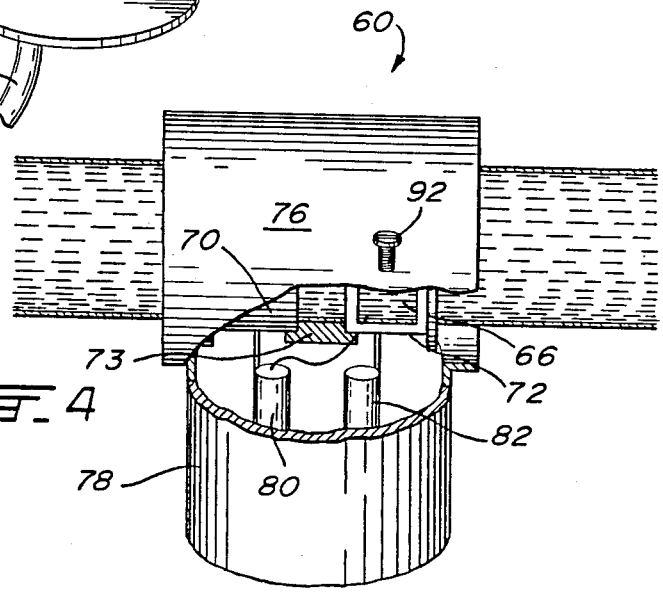
FIG. 4 is a variant of the device illustrated in FIG. 3.

FIG. 4 illustrates a variant of plasma generator 60. In this case, coupler 66 is mounted adjacent to sleeve 72 and establishes directly a capacitive coupling therewith instead through the intermediary of conductor 82. The position of coupler 66 is also adjustable by rotating the dielectric screw 92 engaged in casing 76 or 78, as explained earlier.

Plasma generators 30 and 60 operate well in a frequency range between 10 MHz and 1 GHz. However this frequency range maybe extended.

Figure 5:
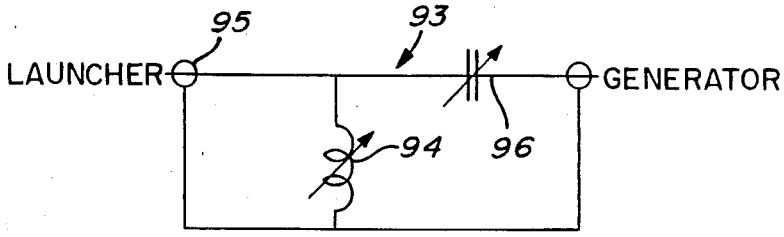
FIGS. 5 and 6 are schematic diagrams of impedance matching networks accordinag to this invention.

As an example, FIG. 5 shows a diagram of an impedance matching network 93 operating well in a frequency range between 500 KHz and 150 MHz. This frequency range can be further extended. The impedance matching network 93 may advantageously be used with the wave launching structures 32 or 62, already described. Impedance matching network 93 is a lumped element two port circuit adapted to be inserted between the launcher and the coaxial feeding line from the power generator. The circuit is attached to the launcher with a coaxial link and comprises a variable coil 94 and a variable capacitance 96. For using network 93 with the launching structure 32 illustrated in FIG. 2, the output port 95 may be connected to structure 32 through the coaxialconnector 54. In that case, the coupler 48 is to be completely removed from launcher 32.

Figure 6:
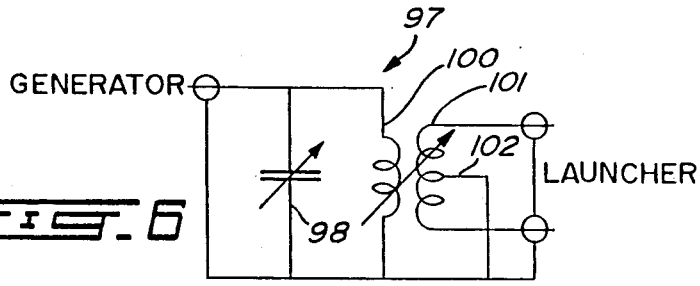
Figure 8:
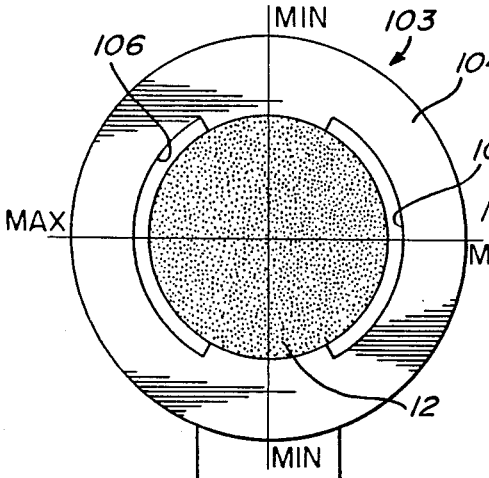
FIGS. 8 to 14 illustrate various possible embodiments of plasma shaping devices according to this invention.
Figure 8:
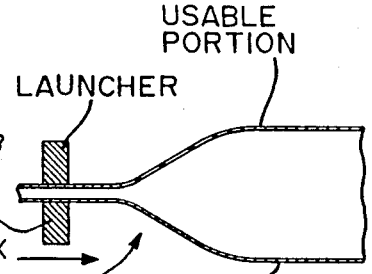
Figure 9:
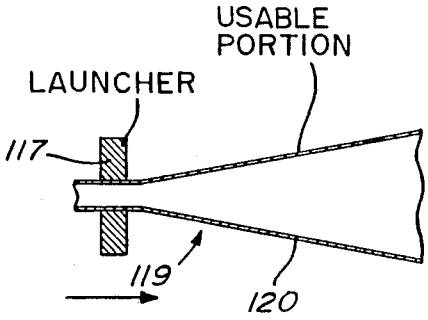

The diagram in FIG. 6 shows another example of a lumped elements impedance matching network 97, operating well in a frequency range between 500 KHz and 150 MHz and which may be further extended if desired. Network 97 establishes a connection with a launching structure through a symmetric line and comprises a variable capacitor 98 connected in parallel to the primary winding of a variable transformer 100. The output terminals of the secondary winding 101, of transformer 100 are connected to the launching structure, which may advantageously be the launcher 62, shown in FIGS. 3 and 4. The middle point 102 of secondary winding 101 is to be connected to the shielding box of the matching network and to the casing 76.

If the launching structure 62 is to be utilized with network 97, conductos 80, 82 and coupler 66 are to be removed. Subsequently, the output terminals of secondary winding 101 are connected to members 70 and 72 respectively.

Figure 7:
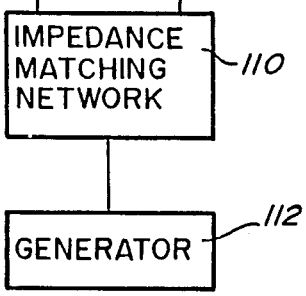
FIG. 7 is an elevational view of an azimuthally non symmetric surface wave plasma generator.

The launching structures which have been described above are adapted to excite azimuthally symmetric waves. When an azimuthally non symmetric wave excitation is required, for example, the plasma generator 103 illustrated in FIG. 7 may be used. The launcher 103 excites waves of dipolar symmetry. The launching structure 104 comprises two substantially semi-circular members 106 and 108 facing each other and being mounted on either side of a plasma vessel 12. To the launching structure 104 is connected an impedance matching network 110 which is fed by a power generator 112.

In order to achieve a proper operation of the plasma generator 103, an impedance matching network of symmetric output has to be employed. It can comprise either a lumped-parameters network such as that shown in FIG. 6, or a section of a symmetric transmission line and a coupler, such as shown in FIG. 3 and in FIG. 4.

The operation of the lauching structures 32 and 62 is as follows.

Initially, when no plasma is present in the dielectric vessel 12, and the power generator is activated, an electric field is established in the launching gap region. If the electric field is of a sufficient amplitude, it ionizes the gas contained in the vessel, producing the plasma. Subsequently, a surface wave can propagate along the interface formed by the walls of tube 12 and the plasma.

The plasma generator 103, for launching azimuthally non symmetric surface waves, operates as follows.

When the power generator is activated, an electric field transverse to the axis of tube 12 will be established between members 106 and 108. The gas in vessel 12 will be ionized and plasma will be produced. Subsequently, surface waves of a dipolar symmetry can be exited and propagate along the interface between the plasma and the walls of the tube 12, sustaining the plasma column.

Since the launcher 104 does not completely encircle tube 12, the excited wave will have an amplitude which is not constant when measured along the circumference of tube 12. In other words, the wave will be azimuthally non symmetric. The amplitude of the propagating wave will be maximum in the region designated "MAX" in FIG. 7, whereas the minimum "MIN" will be situated in a position generally transverse to the maximum amplitude position.

The property of the propagating surface wave which resides in that it is always concentrated in the vicinity of the plasma-dielectric interface can be advantageously used to extend the variety of dimensions and shapes of the plasma beyond the limits imposed by a straight cylindrical constant diameter plasma tube. The surface wave plasma generators which may be used for this purpose are not limited to those described earlier.

FIGS. 8 to 11 illustrate plasma vessels 119 comprising each a usable portion 120 whose shape and/or size different substantially from the shape and/or size of the portions of vessels 119 on which are mounted the surface wave launchers 117. The diameter of the plasma tube 119 can be increased (FIGS. 8 and 9) or reduced (FIGS. 10 and 11) along the wave path.

Efficient surface wave generators cannot have aperture diameters larger or close to $\lambda/4$ otherwise a lesser amount of the EM energy emitted by the generator is converted into surface wave energy, since the available EM energy has the tendency to be transformed into space waves. For this reason it seems more efficient to use tube diameters that are smaller than $\lambda/4$, or still better, less than $\lambda/8$. Practically, this corresponds to a 45 mm diameter plasma at 915 MHz and to about a 15 mm one at 2.45 GHZ. These diameter values can be too small for some application. Decreasing the wave frequency would allow to produce a larger diameter plasma but this usually considerably reduces the electron density (except at high gas pressures). One way of increasing the plasma diameter and keeping a relatively high value of electron density, is to use the plasma vessels of FIGS. 8 and 9.

Figure 10:
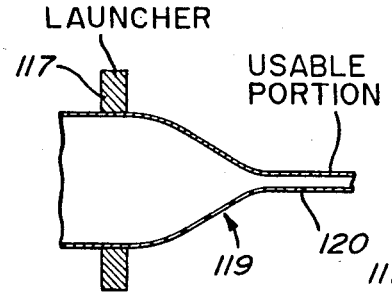

For tube diameters that are smaller than the aperture of the launcher available, the plasma column may be excited by disposing directly part of this smaller tubes into the launcher. However, this method is not efficient in term of the EM energy converted into surface waves. The largest launcher efficiency for surface wave is achieved when the plasma diameter is very close to the launcher aperture. This means that generation of plasma in a vessel with usable portion diameter is much smaller than the launcher aperture should be achieved as shown in FIG. 10.

Regarding the tapered plasma vessels shown in FIGS. 8 to 11, the transition portions between the usable portion of the plasma vessel and the portion thereof receiving the plasma generator, over which the plasma progressively changes to the required shape and size should be long enough to be smooth. Otherwise, an important part of the surface wave energy will be reflected back toward the launcher and part of the surface wave energy will be converted, at the transition point, into a radiation wave or space wave (a space wave is a wave that propagates in all directions and, is not attached to the plasma-tube interface). In that respect, experience shows that a transition over half a free space wavelength seems to be a good compromise.

Figure 11:
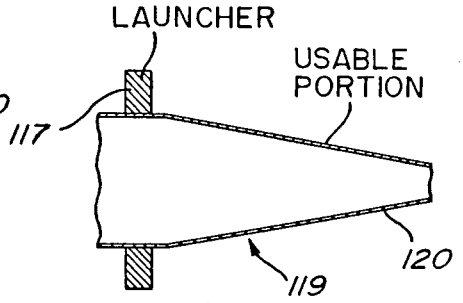

It has been shown experimentally and theoretically that the electron densityin SW produced plasma decreases in the direction of propagation, which means that the plasma column produced, is actually non-uniform. This phenomena may be a disadvantage in certain application. For correcting this non-uniformity the plasma tube diameter may be gradually decreased in the direction of propagation, as illustrated in FIG. 11. The required tapering of the tube can be determined experimentally or calculated (see further FIG. 20). Another way of reducing the axial non-uniformity of the plasma is to use a T-shaped tube described hereinafter.

FIG. 14 shows such an arrangement. The wave emerges from the launcher at the base 121 of the T-shaped plasma vessel 122, where it separates into two waves of the same power flow, propagating in opposite directions in the two arms 124 and 126, respectively of vessel 122. For a given plasma length along thearms 124 and 126, the plasma is more uniform axially than if one launcher was located at one end of a straight tube having the same lenght. This may be visualized on the graph of FIG. 14*a* showing the electron density (N) with respect to the distance (Z) along the arms or conduits 124 and 126.

Figure 15:
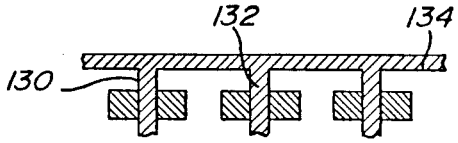

FIG. 15 is a variant where T-tubes 130, 132 and 134 have been stacked to have a longer plasma column with an axial denslity variation as small as possible. Note that in this case, the various launchers should not be supplied from the same power generator, i.e., the surfacewaves excited by various launchers should not be coherent one with the others, otherwise they will interfere and a standing wave pattern will appear along the plasma column.

Figure 16:
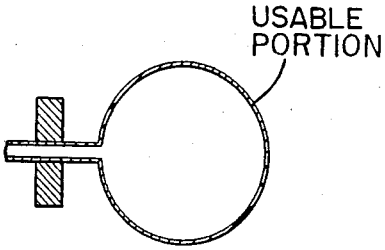
Figure 17:
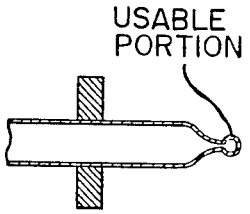

FIGS. 16, 17 and 18 illustrate plasma vessels having bulb-shaped usable portions of bulb shapes.

FIGS. 16 and 17 show how to obtain a spherical plasma. The device in FIG. 17 can be used, for example, to produce a high density plasma for a spectral lamp that can abe considered optically as a point source.

Figure 13:
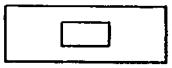

FIG. 19 is a cross sectional view, transverse to the axis of the plasma vessel and showing that an annular plasma can be produced, using two concentric tubes 150 and 156 the ionized gas being located in-between these two tubes. Also, as illustrated in FIG. 13, an annular plasma having a rectangular cross-section can be obtained.

Figure 12:
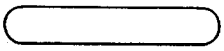
Figure 12A:
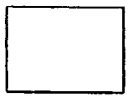

Also, plasmas of flat or rectangular cross-sections may be obtained by using the design shown in FIGS. 12 and 12*a*, being respectively cross-sectional views of a flat and rectangular usableportions of plasma vessels.

The shapes given above are only examples and are not limitative of the shapes and dimensions of plasmas that can be obtained with the surface wave technique.

An example of a fluorescent lamp 138 that can be constructed with elements from the present invention is illustrated in FIG. 18. In this example, the plasma generator 140 is provided with a lumped circuitry matching network, the generator 140 acting also as a base holder for the lamp 138. The tube 142 illuminates as a result of the surface wave emitted by the launcher that propagates along the tube envelope (the surface wave plasma generator and the light tube could be arranged in a large variety of ways depending on the intended application). Tube 142 contains for example, mercury vapor generating ultra violet light converted into visible light by using some appropriate coating (e.g. phosphorus) on the tube inner wall.

The insert in FIG. 20 shows a cross-sectional view of a tapered plasma vessel 200 on which is mounted a surface wave generator 210 of a suitable type. On the same figure is also shown the graph givaing the relation of the normalized electron density $n(Z)/n(z_1)$ of the plasma in vessel 200 with reference to the normalized axial distance $z/z_1$ of the plasma vessel. The value $z_1$ corresponds to the position of the launching plane.

More specifically, vessel 200 has a conical shape and comprises ends 212 and 214, closed or connected to other parts of the apparatus. The cone angle of vessel 200 is designated by $\phi$.

It has been observed that the axial density of the plasma in vessel 200 depends upon the shape and the size of the latter and may be varied, as will be shown hereinafter.

With reference to FIG. 20, the surface waves are excited in the $z_a$ plane and travel in both directions along the z axis. The waves travelling in the z and $-z$ directions are designated "upward" and "downward" wave, respectively.

The electron density in a column sustained by the downward wave decreases, increases or remains constant with an increasing distance from the wave launching plane, depending upon the value of $2\alpha_z z_1$, ($\alpha_1$, being the wave attenuation coefficient at $z=z_1$. Thus, conditions ($\phi$, gas pressure, electron density) may be sought, for which the density is axially uniform. This feature can be of interest for some applications.

The specific description of several embodiments of the present invention should not be interpreted in any limiting manner since it is given only for illustrative purposes. The scope of this invention is defined in the following claims.

The embodiments of the invention in which an exclusive property or privilege is claimed are defined as follows:

1. A device for generating a plasma in a dielectric vessel containing a gas to be energized, said device comprising:

an electromagnetic surface wave launching structure having an opening adapted to receive therein said vessel, said wave launching structure including first and second metallic members slightly spaced apart from each other in order to define a launching gap therebetween for establishing an electromagnetic field configuration suitable for propagating a surface wave in said vessel;

a coupler mounted to said wave launching structure and being electrically insulated from said first and second metallic members, said coupler defining a capacitance with one of said members and being adapted to be connected to a power generator for coupling power therefrom to said wave launching structure through said capacitance; and a tuner constituted by a section of a shortcircuited coaxial transmission line connected between said first and second members for introducing an imaginary impedance therebetween, said first and second metallic members being electrically connected solely through said tuner.

2. A device for generating a plasma in a dielectric vessel containing a gas to be energized, said device comprising:

an electromagnetic surface wave launching structure having an opening adapted to receive therein said vessel of dielectric material, said wave launching structure having an opening adapted to receive therein said vessel of dielectric material, said wave launching structure including first and second metallic members slightly spaced part from each other in order to define a launching gap for establishing an electromagnetic field configuration suitable for propagating a surface wave in said vessel;

a coupler mounted to said wave launching structure, the coupler defining a capacitance with said launching structure and being adapted to be connected to a power generator for coupling power therefrom to said wave launching structure through said capacitance; and tuning means of the balanced line type attached to said wave launching structure and being electrically connected to said first and second members for introducing an imaginary impedance therebetween, said first and second metallic members being connected solely through said tuning means.

3. A device for generating a plasma in a dielectric vessel containing a gas to be energized, said device comprising:

an electromagnetic surface wave launching structure having an opening adapted to receive said vessel of dielectric material, said wave launching structure including first and second metallic members slightly spaced part from each other to define a launching gap therebetween for establishing an electromagnetic field configuration suitable for propagating a surface wave in said vessel; and an impedance matching network connected between said first and second members and being formed of lumped elements, said network being adapted to be connected to a power generator, said impedance matching network establishing a power transfer from said generator to said surface wave launching structure, said firstand second metallic members being connected solely through said impedance matching network.

4. A device for generating a plasma in a dielectric vessel containing a gas to be energized, said device comprising:

an electromagnetic surface wave launching structure for launching an azimuthally non symmetric surface wave, said structure having an opening adapted to receive therein said vessel, said wave launching structure including first and second metallic members mounted on either side of said vessel and facing each other, said metallic members being slightly spaced part from each other defining a launching zone for exciting an azimuthally non symmetric surface wave for propagating along said vessel;

an impedance matching network connected to said launching structure and adapted to be connected to a power generator supplying energy to said impedance matching network, said power generator operating at a frequency compatible with said impedance matching network and said launching structure, said impedance matching network establishing a high frequency potential at each metallic member, the potentials at said first and second metallic members having a defined phase difference therebetween, said first and second metallic members being connected solely through said impedance matching network.

5. A device as defined in claim 1, wherein said surface wave has a frequency between 10 MHz and 1 GHz.

6. A device as defined in claim 1, wherein said transmission line is flexible.

7. A device as defined in claim 1, wherein said first metallic member is constituted by a metallic sleeve adapted to be inserted on said vessel and closely conforming thereto, said sleeve having at one end a flange projecting radially and outwardly relative to the axis of said vessel.

8. A device as defined in claim 7, wherein said second metallic member is constituted by a tube coaxially mounted on said metallic sleeve and being attached thereto by a ring of insulating material, said tube having at one end a wall projecting radially and inwardly relative to the axis of said vessel and defining with the end of said metallic sleeve, opposite said flange, said launching gap.

9. A device as defined in claim 1, wherein said transmission line is connected between said first and second members through a connector.

10. A device as defined in claim 2, wherein the frequency of said surface wave is between 10 MHz and 1 GHz.

11. A device as defined in claim 2, wherein said tuning means comprises two parallel metallic conductors attached respectively to said first and second metallic members, said conductors being short-circuited by a metalllic member mounted on said conductors and being slidable thereon.

12. A device as defined in claim 11, wherein said coupler comprisesa metallic plate facing and being adjacent to one of said conductors.

13. A device as defined in claim 11, wherein said coupler comprises a metallic plate facing and being adjacent to one of said members.

14. A device as defined in claim 11, wherein said device is enclosed in a metallic casing.

15. A device as defined in claim 14, being characterized in that saidcoupler is attached to a dielectric screw threadedly engaged in said casing, wherein by rotating said screw the position of said coupler relatively to the launching structure may be varied.

16. A device as defined in claim 2, wherein said metallic members are constituted by two symmetrical metallic sleeves through which is to be inserted said vessel.

17. A device as defined in claim 3, wherein said surface wave has a frequency between 500 kHz and 150 MHz.

18. A device as defined in claim 3, wherein said impedance matching network is connected through a coaxial line to said wave launching structure.

19. A device as defined in claim 18, wherein said impedance matching network comprises a variable capacitor and a variable inductance.

20. A device as defined in claim 2, wherein the impedance matching network is a lumped element network with symmetrical output.

21. A device as defined in claim 2, wherein said impedance matching network is connected to said launching structure with a symmetrical line.

22. A device as defined in claim 21, wherein said impedance matching network comprises a variable capacitor and a transformer.

23. A device as defined in claim 4, wherein said members have a substantially semi-circular shape.

24. A device as defined in claim 4, wherein said impedance matching network is of the lumped circuit type with symmetrical output.

* * * * *